United States Patent [19]

Burns

[11] 3,948,230

[45] Apr. 6, 1976

[54] ROTARY ENGINE PROVIDED WITH FIRST AND SECONDARY ROTATABLY MOUNTED ROTORS

[75] Inventor: Alan Robert Burns, City Beach, Australia

[73] Assignee: Ruapehu Pty. Ltd., City Beach, Australia

[22] Filed: May 17, 1974

[21] Appl. No.: 470,908

[52] U.S. Cl. ..... 123/55 R; 123/197 R; 123/55 AA; 123/56 C

[51] Int. Cl.[2] ..... F02B 75/22

[58] Field of Search ..... 123/55 AA, 44 E, 197 R, 123/56 C, 55; 92/148, 72; 417/273

[56] References Cited

UNITED STATES PATENTS

| | | | |
|---|---|---|---|
| 395,039 | 12/1888 | Dake | 92/177 X |
| 717,445 | 12/1902 | Nestius | 123/55 AA |
| 1,765,713 | 6/1930 | Boland | 123/55 AA |
| 3,572,209 | 3/1971 | Aldridge et al. | 123/55 AA |
| 3,584,610 | 6/1971 | Porter | 123/55 AA |

FOREIGN PATENTS OR APPLICATIONS

| | | | |
|---|---|---|---|
| 252,419 | 10/1948 | Switzerland | 123/56 C |

*Primary Examiner*—Charles J. Myhre
*Assistant Examiner*—William C. Anderson
*Attorney, Agent, or Firm*—Ulle C. Linton

[57] ABSTRACT

A rotary engine comprising a substantially cylindrical outer casing, a central drive shaft, a substantially triangular shaped first rotor mounted to said drive shaft substantially "clover" shaped secondary rotors one rotatably mounted to each of the three lobes of said first rotor, rotation of the drive shaft and first rotor being in the reverse direction from the secondary rotors, lobes of said secondary rotors engaging the base pistons which are provided in chambers formed within the outer casing.

6 Claims, 4 Drawing Figures

ROTARY ENGINE PROVIDED WITH FIRST AND SECONDARY ROTATABLY MOUNTED ROTORS

This invention resides in a rotary engine.

In one form the invention resides in a rotary engine comprising a substantially cylindrical outer casing, a central drive shaft, a substantially triangular shaped first rotor mounted to said drive shaft, substantially "clover" shaped secondary rotors one rotatably mounted to each of the three lobes of said first rotor, rotation of the drive shaft and first rotor being in the reverse direction from the secondary rotors, lobes of said secondary rotors engaging the base of pistons which are provided in chambers formed within the outer casing.

The invention will be better understood by reference to the description of one specific embodiment as shown in the accompanying drawings wherein.

Figure 1:
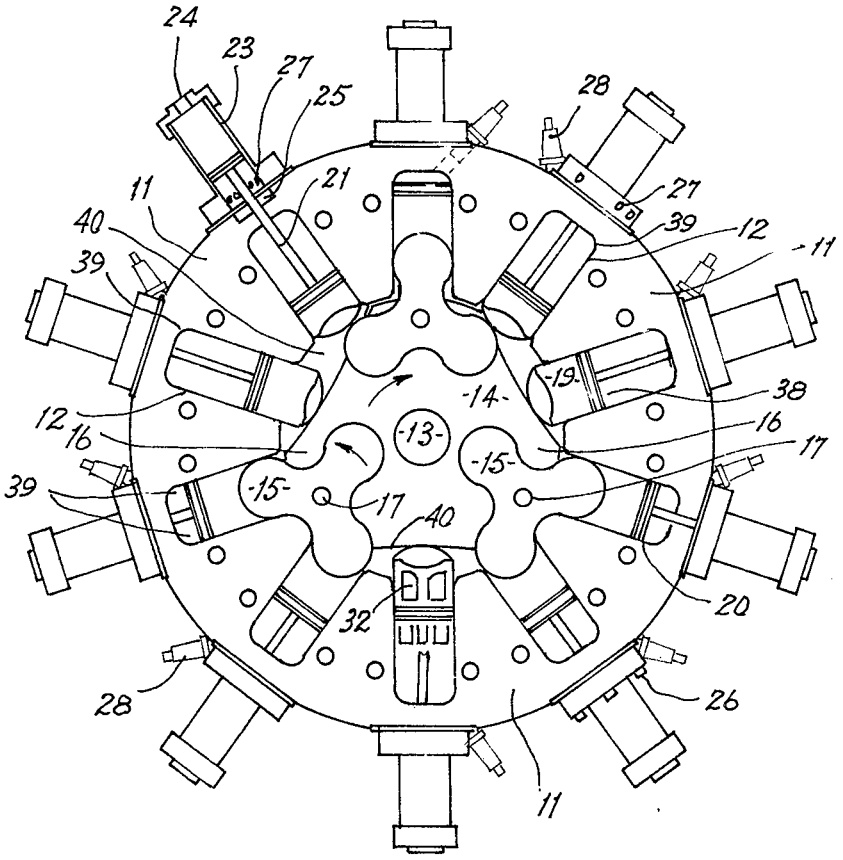
FIG. 1 is a part sectional elevation of the invention.

In this embodiment a rotary engine is constructed comprising a substantially cylindrical outer casing 11 within which is formed a plurality of chambers 12. A central drive shaft 13 has a substantially triangular shaped first rotor 14 mounted thereon. The triangular shaped first rotor 14 is constructed in two sections as revealed in FIG. 2 of the accompanying drawings. Secondary substantially "clover" shaped rotors 15 are rotatably mounted one to each of the three lobes 16 of the first rotor 14. The mounting of the secondary rotors 15 to the first rotor 14 is achieved by the use of shaft 17 which is held in position with circlips 18. The secondary rotor freely rotates about shaft 17 whilst the shaft itself is held stationary by both sections of the first rotor 14. Whichever direction of rotation is used by the central drive shaft 13, then the first rotor 14 will also rotate in this direction. The secondary rotors 15 move in the reverse direction with each lobe engaging the concave section 29 of the base of every third piston 19. The pistons 19 may be cylindrical or rectangular in appearance and in this particular representation of the invention they are rectangular. Suitably shaped "rings" 20 are provided around the piston head for sealing purposes. The top face 38 of the piston 19 has a small threaded hole formed in it to receive the threaded end of an air piston control rod 21. The control rod 21 projects through the outer casing into an air cylinder 23 which is mounted upon a bronze guide and sealing unit 25. The complete unit then being secured to the periphery of the outer casing by way of bolts 26. The outermost end of control rod 21 is fitted with an air piston head 22. The result being that any travel by piston 19 causes the same amount of travel by air piston 22. All air chambers 23 are linked together by hoses (not shown) which connect the air passage inlet/-outlets 24 together. The air chambers 23 are subjected to a constant pressure such that when piston 19 is on its compression stroke then the amount of pressure within the air chamber 23 must be sufficient to prevent the rectangular head of the piston 19 from travelling up too far and damaging the upper curved corners 39 of chambers 12.

Figure 2:
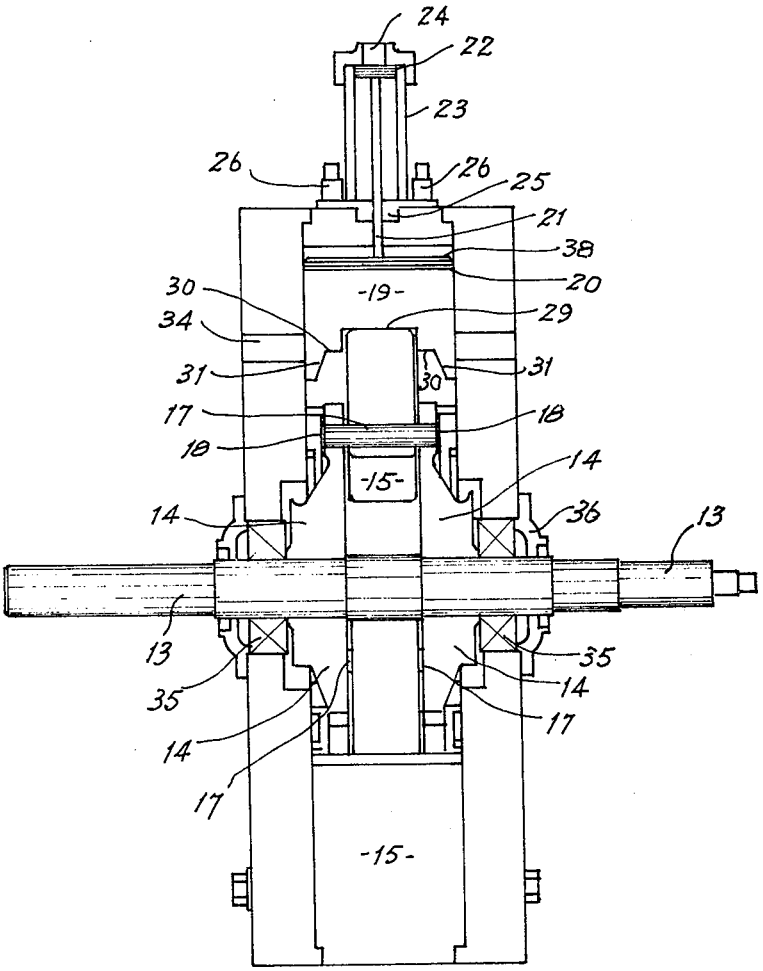
FIG. 2 is a part sectional elevation of one piston and relating chamber.
Figure 3:
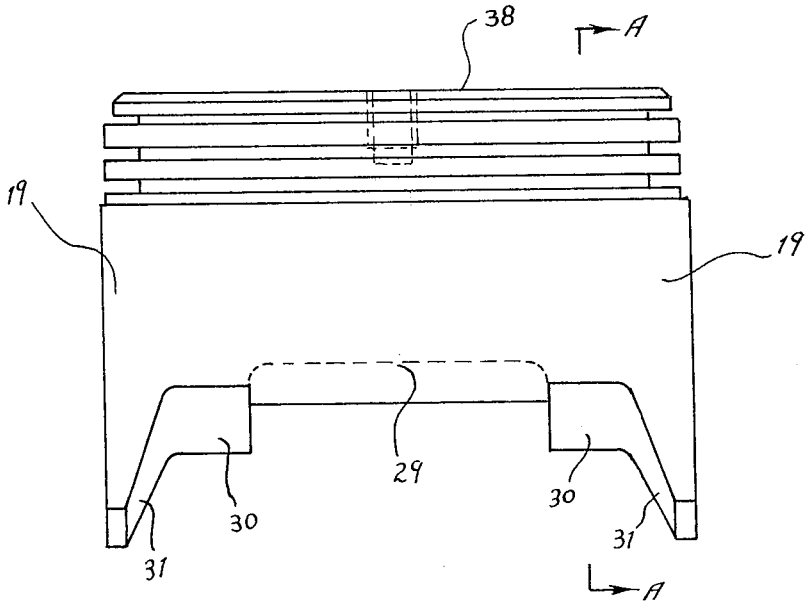
FIG. 3 is a side elevation of the piston and FIG. 4 is taken on line A—A of FIG. 3.
Figure 4:
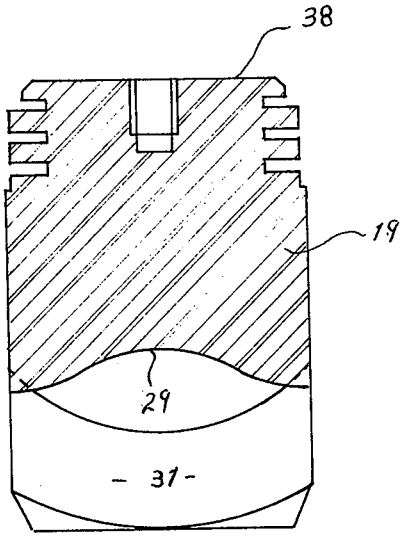

So that a build up of pressure does not occur behind the air piston 22, air escape gaps 27 are provided to allow free entry and exit of air. A sparking means 28 is provided for ignition of the combustible fuels which are fed into chamber 12 through inlet port 33. With the piston 19 being at a point of "Top Dead Centre", the concave base portion 29 of piston 19 is in contact with the vertex of one of the lobes of the secondary rotor 15 as illustrated in FIG. 2 of the drawings. As the piston begins its downward travel the secondary rotor is caused to rotate and moves away from piston 19 and advances towards another piston. The next piston to be engaged by that particular lobe is the third one around. As the secondary rotor 15 moves away from piston 19, the periphery 40 of the first rotor 14 comes into contact with the convex portion 30 of the base of piston 19. The convex portion 30 being situated between the skirt 31 of piston 19 and the concave portion 29. The piston travels on the periphery 40 of the first rotor 14 until it is engaged by a lobe of the secondary rotor 15. So that each lobe may move freely away from the concave portion 29 of the piston, the innerface 37 of the casing between each chamber is shaped to both guide and control the passage of the secondary rotor lobes. Situated slightly above and opposite the inlet port 33 is the exhaust port 34. The piston 19 is provided with cut-away sections 32 to allow air to pass longitudinally through the piston head to assist in cooling. The central drive shaft 13 is mountd between bearings 35 and held in position by end plates 36.

In operation, during the power stroke air is being passed through the inlet port 33, through piston head 19 and out the exhaust port 34. As the piston head 19 moves downwardly the passage of air through the piston is shut off and the exhaust port 34 is opened to the burnt gases. Further downward travel allows the inlet port 33 to be opened and the entry of forced air assists to completely purge the combustion chamber 12 of any gases. At this stage the piston 19 is in frictional contact with the periphery 40 of the first rotor 14 and there is a slight pause at what may be commonly termed as "Bottom Dead Centre", as the Piston 19 rides over the minor radius of the first rotor 14. During this pause the chamber 12 is being cleaned by the air flow from the inlet port 33. Further rotation of the first rotor 14 commences the upward stroke of the piston 19 which is continued as the rotating secondary rotor 15 engages the concave surface 29 of the piston 19. Fuel is injected into the chamber 12 through the inlet port 33 just prior to the piston 19 closing off the inlet port opening. The air speed of the injected fuel being such that the exhaust port 34 is closed by the upward movement of the piston 19 before any of the combustible fuels can escape. Further upward movement of the piston 19 causes the gases contained within the chamber 12 to be compressed and ignition then occurs. The expanding gases force the piston 19 downwardly and the force is relayed by the secondary rotor 15 to the first rotor 14 and to the central drive shaft 13. The operation in the combustion chambers being of the 2-stroke principle. Whilst the piston 19 is at "Top Dead Centre" the air piston 22 is also at the top of its stroke and the air within the air cylinder 23 is forced through the lines (not shown) to other air cylinders. The air from one cylinder at "Top Dead Centre" being passed to maintain an even pressure in the cylinder which is at "Bottom Dead Centre", i.e. all air cylinders are kept at the same constant pressure.

With the rotation of the minor rotors 15 each lobe engages every third piston head 19 and as shown in the accompanying drawings, a ten chamber engine is required for a three lobe first rotor fitted with three, three lobe secondary rotors. This gives the engine thirty firing positions per revolution and creates tremendous power. Suitable lubricating and cooling means are provided where necessary.

The reciprocation of the pistons is achieved by the hypercycloidal path followed by the lobes of the secondary rotors moving within the circle of the cylinder block, and not by the use of the cam of the first rotor.

The cam face of the first rotor functions to accelerate the piston to the same velocity and acceleration as that of the secondary rotor lobes as they approach the base of the piston, and to decelerate the piston at the completion of the power stroke. Also the minor dia. of the cam face provides the positive positioning of the piston at Bottom Dead Center.

Whilst the invention has been described with reference to one specific embodiment thereof, it is not limited thereto as the engine may be constructed with cylindrical pistons. Other suitable means could be used to ensure that the head of the piston can not hit the top of the combustion chamber or lift off the secondary rotor or cam face. Thereby eliminating the need for the air chambers, which are fitted to the periphery of the engine casing.

If desired the engine may be constructed without the use of pistons 19 whereby the lobes on rotor 15 will serve as pistons and engage the chambers during rotation. The lobe on rotor 15 compressing the combustible fuel within the chamber and carrying out the function of piston head 19.

The invention has been described with reference to an internal combustion engine however the principle of using first and secondary rotors can also be applied to hydraulic motors, compressors, pumps, vacuum pumps and steam engines or the like.

I claim:

1. A rotary engine comprising a substantially cylindrical outer casing having chambers formed therein, pistons in said chambers, a central drive shaft, a substantially triangular shaped first rotor mounted to said drive shaft, substantially "clover" shaped secondary rotors one rotatably mounted to each of the three lobes of said first rotor, rotation of the drive shaft and first rotor being in the reverse direction from the secondary rotors, and lobes of said secondary rotors engaging the base of said pistons which are provided in chambers formed within the outer casing.

2. A rotary engine as claimed in claim 1 wherein the said pistons are provided with a concave portion on their base for engagement with said secondary rotors.

3. A rotary engine as claimed in claim 1 wherein each lobe of said secondary rotor engages every third piston during rotation.

4. A rotary engine as claimed in claim 1 wherein the pistons are rectangular.

5. A rotary engine as claimed in claim 1 wherein a convex portion is provided on the base of each piston to frictionally engage the periphery of said first rotor when the lobe of said secondary rotor moves away from a concave portion also provided on the base of said pistons.

6. A rotary engine comprising a substantially cylindrical outer casing having chambers therein, a central drive shaft, a substantially triangular shaped first rotor mounted to said drive shaft, substantially "clover" shaped secondary rotors one rotatably mounted to each of the three lobes of said first rotor, rotation of the drive shaft and first rotor being in the reverse direction from the secondary rotors, and lobes of said secondary rotors engaging and entering said chambers provided within the outer casing to compress fuel contained therein.

* * * * *